US005105720A

United States Patent [19]

Horng

[11] Patent Number: 5,105,720

[45] Date of Patent: Apr. 21, 1992

[54] OSCILLATING PISTON CONTROLLED BY PILOTED VALVE, PISTON POSITION CONTROLS PILOT VALVE

[76] Inventor: Tat Y. Horng, No. 4, Lane 332, Fengchou Rd., Shenkang Hsiang, Taichung Hsien, Taiwan

[21] Appl. No.: 701,030

[22] Filed: May 16, 1991

[51] Int. Cl.[5] ..... F01L 25/02

[52] U.S. Cl. ..... 91/308; 91/311; 91/313; 91/314

[58] Field of Search ..... 91/308, 311, 313, 314

[56] References Cited

U.S. PATENT DOCUMENTS

| | | | |
|---|---|---|---|
| 962,766 | 6/1910 | Lacy et al. | 91/313 |
| 1,152,566 | 9/1915 | Snediker | 91/313 |
| 1,935,792 | 11/1933 | Farmer | 91/313 |
| 2,237,871 | 4/1941 | Stone | 91/313 |
| 3,093,122 | 6/1963 | Sachnik | 91/342 |
| 3,347,713 | 3/1968 | Broughton | 91/313 |
| 4,062,639 | 12/1977 | Conlee | 91/308 |
| 4,348,161 | 9/1982 | Shibata | 91/313 |

*Primary Examiner*—Edward K. Look
*Assistant Examiner*—F. Daniel Lopez
*Attorney, Agent, or Firm*—Staas & Halsey

[57] ABSTRACT

A cylinder including a housing disposed between a head and a board, a body disposed in the housing and closely contacted with the head, a piston slidably disposed in the housing, a piston rod coupled to the piston, a valve including five rings being disposed in the head, a valve including five annular grooves being disposed in the body, an inlet being formed in the head for continuously supplying hydraulic oil into the cylinder, the piston can be urged to move in a reciprocating action without changing the supplying direction of the hydraulic oil.

7 Claims, 7 Drawing Sheets

OSCILLATING PISTON CONTROLLED BY PILOTED VALVE, PISTON POSITION CONTROLS PILOT VALVE

BACKGROUND OF THE INVENTION

1. Field of the Invention

The present invention relates to an oscillating cylinder, and more particularly to an oscillating cylinder which can be operated without microswitches.

2. Description of the Prior Art

Typical cylinders include a piston slidable within the cylinder. The piston separates the interior of the cylinder into two chambers. A pipe is connected to each of the chambers for supplying hydraulic oil thereto so as to actuate the piston to move in a reciprocating action within the cylinder. The filling and discharging operations of the cylinder are usually controlled by microswitches which may generate sparks during operations, this is dangerous, particularly in an oily environment.

The present invention has arisen to mitigate and/or obviate the afore-described disadvantages of the conventional cylinders.

SUMMARY OF THE INVENTION

The primary objective of the present invention is to provide a cylinder which can be operated without changing the flow directions of the hydraulic oils and can be operated without microswitches.

In accordance with one aspect of the invention, there is provided a cylinder including a housing disposed between a head and a board, a body disposed in the housing and closely contacted with the head, a piston slidably disposed in the housing, a piston rod coupled to the piston, a sleeve slidably received in the upper portion of the piston rod and having one end coupled to the body, a passage being laterally formed in the head, five rings being formed in the passage, an inlet being formed in the head for supplying hydraulic oil to the third ring, a mouth being formed in the head and connecting the fourth ring to the housing below the piston, a rod slidably received in the passage of the head, three discs being formed on the rod, a passageway being formed in the body, a recess being formed in an end portion of the body for slidably receiving a plate, five annular grooves being formed in the passageway, a shaft being slidably received in the passageway of the body and in the sleeve, the plate being fixed to the end portion of the shaft, a washer being fixed to the other end of the shaft, three discs being formed on the shaft, the hydraulic oil supplied into the inlet may flow into the recess for pushing the plate toward the head and may flow into one end of the passage for pushing the rod toward one end of the passage, the hydraulic oil then flowing into the housing in order to push the piston toward the board, the washer and the shaft being pushed by the piston so that the plate moves downward, the hydraulic oil supplied into the inlet may flow into the recess so as to push the plate downward and may flow into the passage to push the rod toward the other end of the passage, the hydraulic oil then flowing into the housing so as to push the piston toward the body, such that the piston can be urged to move in a reciprocating action.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
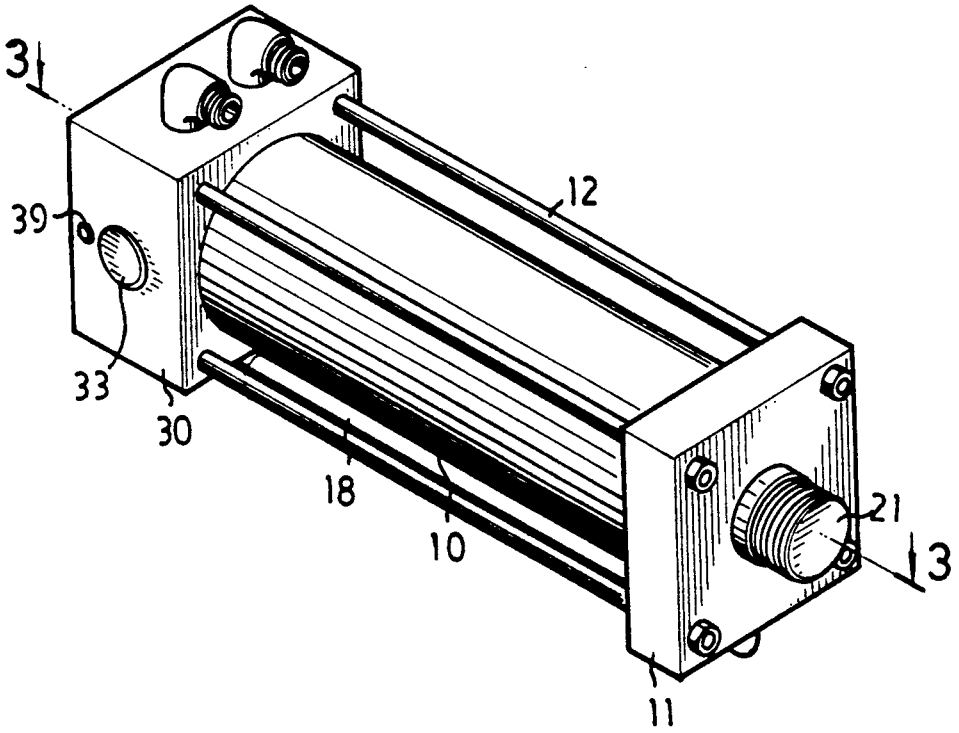
FIG. 1 is a perspective view of a cylinder in accordance with the present invention.
Figure 2:
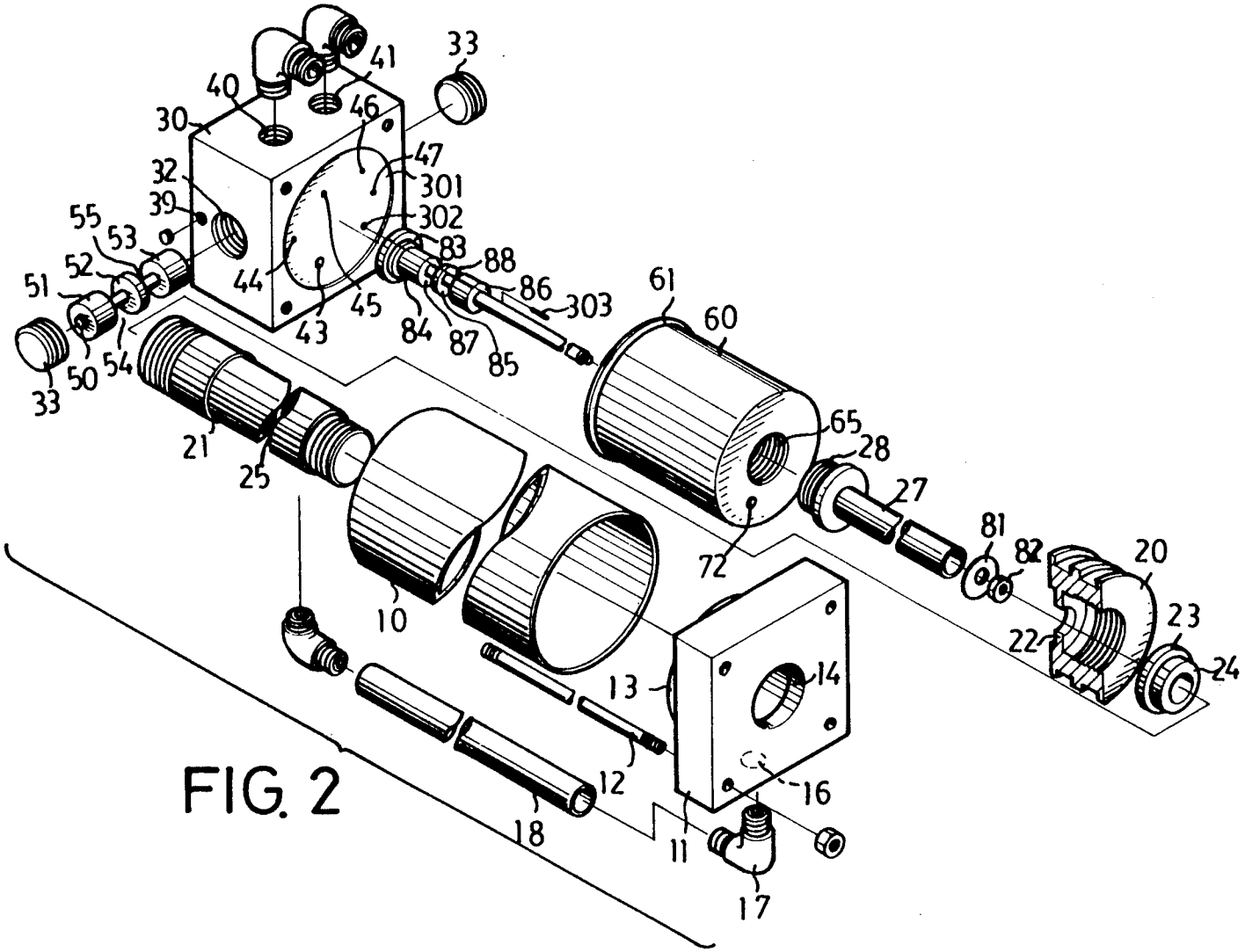
FIG. 2 is an exploded view of the cylinder.
Figure 3:
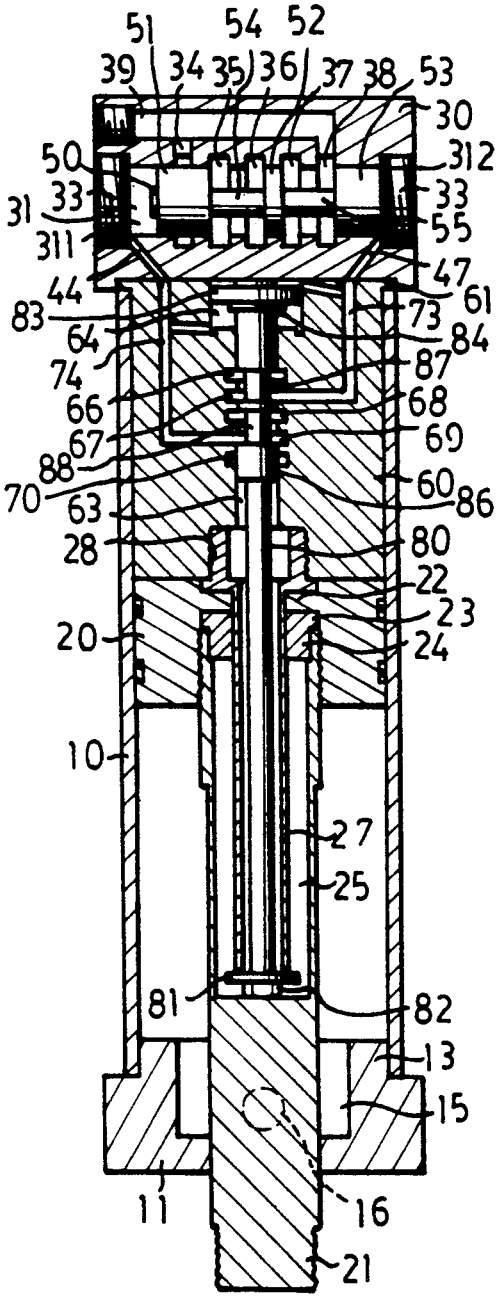
FIG. 3 is a cross sectional view taken along lines 3—3 of FIG. 1.

Referring to the drawings and initially to FIGS. 1, 2 and 3, a cylinder in accordance with the present invention comprises generally a housing 10 disposed between a head 30 and a board 11 which are coupled together by four connecting rod bolts 12; and a body 60 received in the housing 10 and closely contact the head 30. An annular flange 61 is formed on one end of the body 60 and is engaged in a circular depression 301 of the head 30, and is clamped between the head 30 and the housing 10 so that the body 60 can be stably retained in place.

A protrusion 13 which is cylindrical is integrally formed on one side of the board 11 and is engaged within one end of the housing 10. An opening 14 and a cavity 15 of larger diameter are formed in the board 11. An orifice 16 is laterally formed in the board 11 and communicated with the cavity 15. An elbow 17 is engaged in the orifice 16 and is connected to the head 30 by a tube 18. A piston 20 is slidably received in the housing 10 and separates said housing 10 into a first chamber and a second chamber, in which the first chamber is defined between the body 60 and the piston 20, and the second chamber is defined between the piston 20 and the board 11 and communicated with the cavity 15 of the board 11, a piston rod 21 has one end threadedly engaged to the piston 20 and has the other end extended outward of the housing 10 through the opening 14 of the board 11. An annular flange 22 is formed in the piston 20, and an annular flange 23 is formed on one end of a gasket 24 and is stably retained in place by engagement between the annular flange 22 of the piston 20 and the piston rod 21. An emptiness 25 is formed in one end portion of the piston rod 21 close to the piston 20. A sleeve 27 extends through the piston 20 and the gasket 24 and is slidably received in the emptiness 25 of the piston rod 21. An enlarged head portion 28 is formed on one end of the sleeve 27 and has an outer thread formed thereon for threadedly engagement to the body 60.

Figure 4:
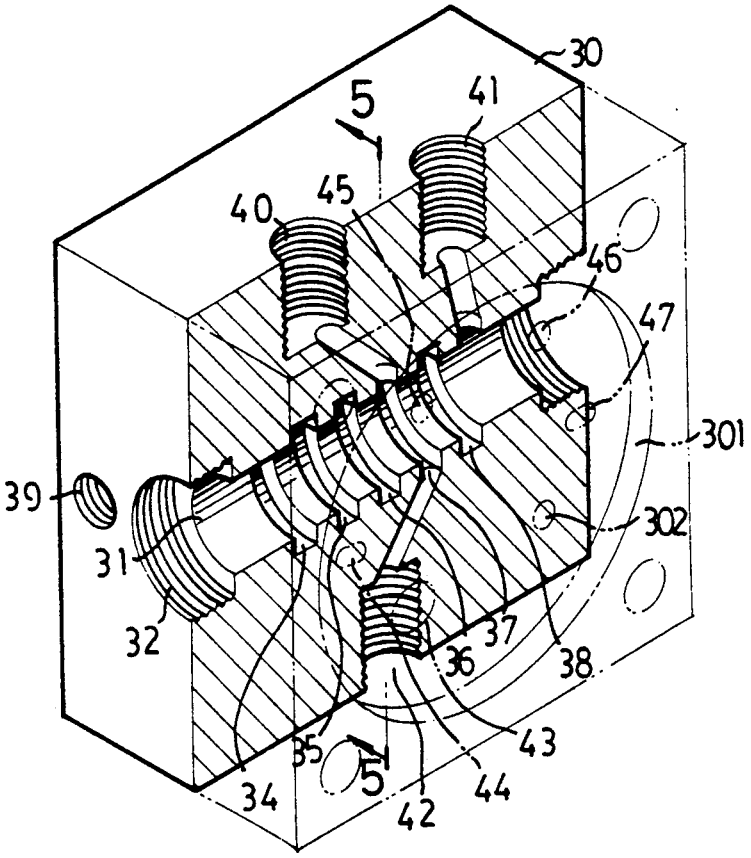
FIG. 4 is a perspective view of the head, in which half of it has been cut off.

Referring next to FIGS. 4 and 5, and again to FIGS. 2 and 3, a passage 31 is laterally formed in the head 30 and has an inner thread 32 formed in each end thereof for threadedly receiving a screw or a bolt 33. Five rings 34, 35, 36, 37, 38 are formed in series in the passage 31 and have a diameter larger than that of the passage 31. A pathway 39 is formed in the head 30 in parallel to the passage 31 and communicates the first ring 34 to the fifth ring 38 (FIG. 3). An inlet 40 and an outlet 41 are formed in the upper portion of the head 30 and communicate to the third and the fifth rings 36, 38 respectively. Inlet 40 is connected to a hydraulic pressure source. A mouth 42 is formed in the lower portion of the head 30 and communicates the fourth ring 37 to the cavity 15 of the board 11 by the tube 18 so that the hydraulic oil can flow from the fourth ring 37 to the cavity 15 of the board 11 and the second chamber of the housing for urging the piston 20 to move toward the body 60.

A pin hole 302 is formed in the depression 301 of the head 30 for receiving a pin 303, which is in turn engaged in a pin hole 62: formed in the body 60 (FIG. 6) so that the body 60 can not rotate relative to the head 30. Five holes 43, 44, 45, 46, 47 are formed in the depression 301 of the head 30, the first hole 43 is connected to the second ring 35, the second hole 44 is connected to a first end 311 of the passage 31, the third hole 45 is connected to the third ring 36, the fourth hole 46 is connected to the fifth ring 38, and the fifth hole 47 is connected to the second end 312 of the passage 31, best shown in FIG. 5.

Figure 5:
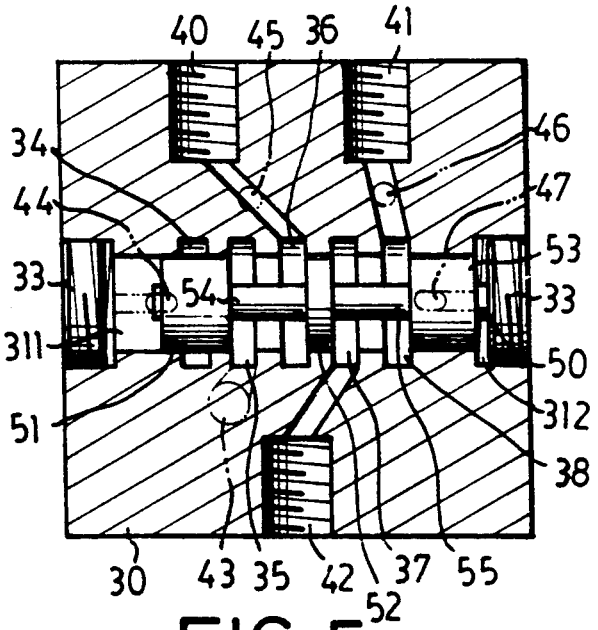
FIG. 5 is a cross sectional view of the head, taken along lines 5—5 of FIG. 4.
Figure 10:
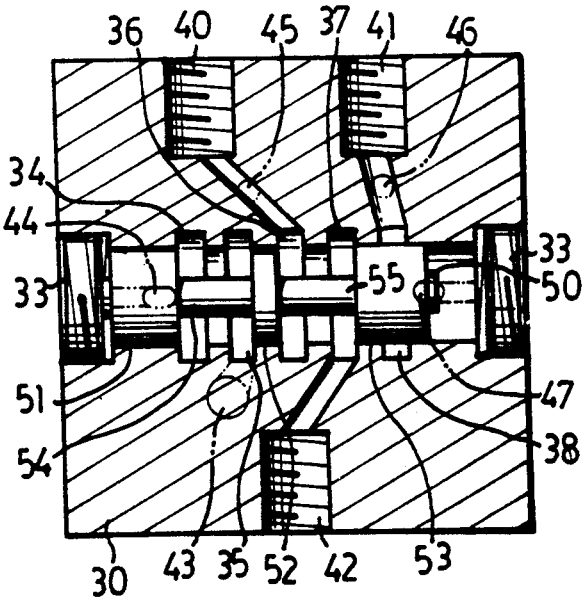

A rod 50 has three discs 51, 52, 53 integrally formed thereon, and has two annular gaps 54, 55 formed between the discs 51, 52 and 52, 53 respectively, and is slidably received in the passage 31 of the head 30. The middle disc 52 has a width smaller than that of the other two discs 51, 53. The diameter of the discs 51 to 53 is equal to the inner diameter of the passage 31. As shown in FIGS. 5 and 10, the width of the gaps 54, 55 is large enough such that the two adjacent rings 35, 36 and 37, 38 (FIG. 5), or 34, 35 and 36, 37 (FIG. 10) can be communicated with each other.

Figure 6:
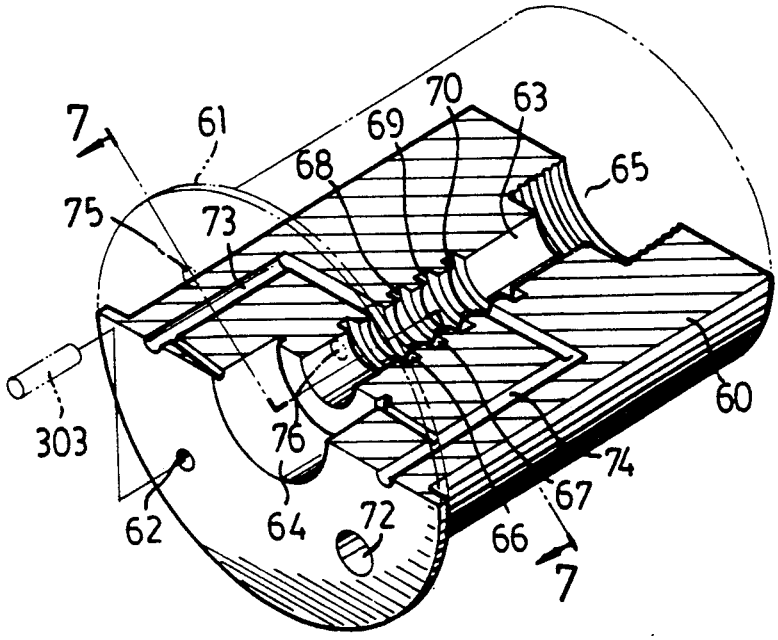
FIG. 6 is a perspective view of the body, in which half of it has been cut off.
Figure 7:
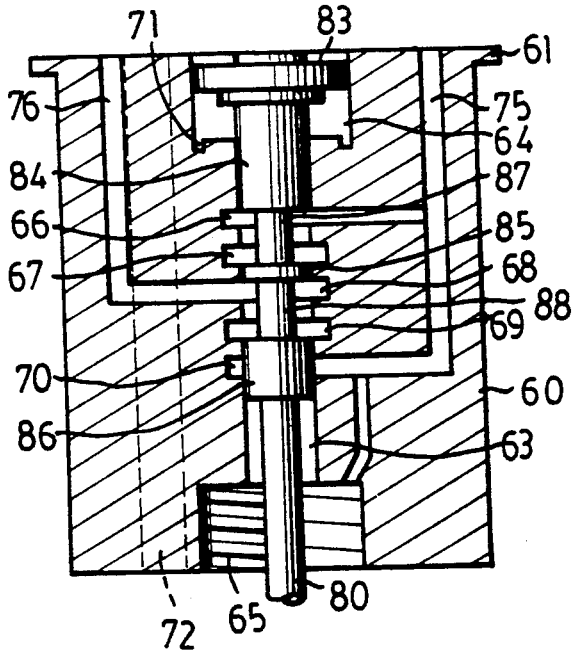
FIG. 7 is a cross sectional view taken along lines 7—7 of FIG. 6.

Referring next to FIGS. 6 and 7, and again to FIGS. 2 and 3, a passageway 63 is longitudinally formed in the middle of the body 60 and has a recess 64, 65 of larger diameter formed in each end thereof. A circular plate 83 is slidably received in the recess 64 and separates the recess 64 into an outer space formed between the head 30 and the circular plate 83 and an inner space formed in the other side of the plate 83. The head portion 28 of the sleeve 27 is threadedly engaged in the recess 65 of the body 60. Five annular grooves 66, 67, 68, 69, 70 are formed in the middle portion of the passageway 63 and have a diameter larger than the inner diameter of the passageway 63. A circular slot 71 is formed in the recess 64 and communicated with the inner space of the recess 64. An aperture 72 is formed through the body 60 and communicates the first hole 43 of the head 30 to the first chamber of the housing 10. As shown in FIGS. 3 and 6, an access 73 communicates the second annular groove 67 to the outer space of the recess 64 and to the fifth hole 47 of the head 30, and an approach 74 communicates the fourth annular groove 69 to the annular slot 71 and to the second hole 44 of the head 30. As shown in FIGS. 6 and 7, a channel 75 communicates the fifth annular groove 70 to the first annular groove 66 and to the fourth hole 46 of the head 30, and a path 76 communicates the third annular groove 68 to the third hole 45 of the head 30.

Figure 9:
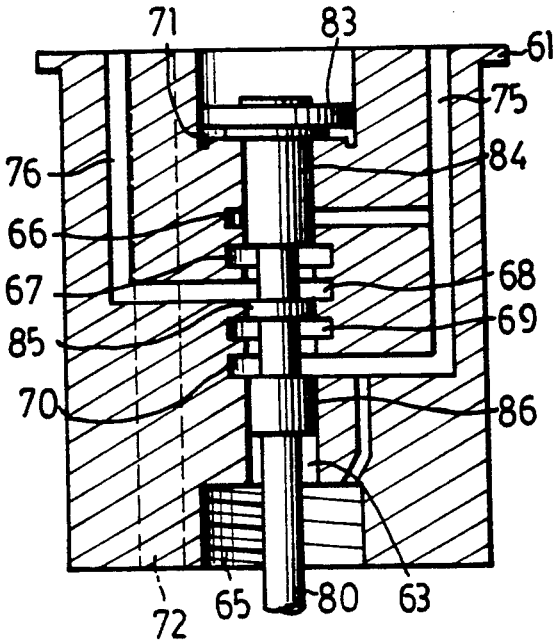
FIGS. 9 and 10 are cross sectional views similar to FIGS. 7 and 5 respectively.

A shaft 80 is slidably received in the passageway 63 of the body 60 and in the sleeve 27. A washer 81 is fixed on the lower end of the shaft 80 by a nut 82. The circular plate 83 is fixed on the upper end of the shaft 80 and is slidably received in the recess 64 of the body 60. Three discs 84, 85, 86 are integrally formed on the upper end of the shaft 80, and two annular gaps 87, 88 are formed between the discs 84, 85 and 85, 86 respectively. The middle disc 85 has a width smaller than that of the other two discs 84, 86. The diameter of the discs 84 to 86 is equal to the inner diameter of the passageway 63 of the body 60. As shown in FIGS. 7 and 9, the width of the gaps 87, 88 is large enough such that the two adjacent annular grooves 66, 67 and 68, 69 (FIG. 7), or 67, 68 and 69, 70 (FIG. 9) can be communicated with each other.

In operation, referring to FIGS. 3 to 7, when hydraulic oil is supplied into the inlet 40 of the head 30 (FIG. 5), the hydraulic oil flows through the third hole 45 into the path 76 of the body 60 (FIG. 7), and flows into the third and the fourth annular grooves 68, 69, and then flows through the approach 74 into the inner space of the recess 64 (FIG. 3) to push the circular plate 83 upward to the position as shown in FIG. 3, and simultaneously, flows through the second hole 44 into the first end 311 of the passage 31 so as to push the disc 51 rightward to the position as shown in FIGS. 3 and 5. At this moment, as shown in FIG. 5, the hydraulic oil can flow through the third and the second rings 36, 35 into the first hole 43 of the head 30, and then flow through the aperture 72 of the body 60 into the first chamber of the piston 20 so that the piston 20 can be pushed downward toward the board 11.

When the piston moves downward, the hydraulic oil contained in the second chamber of the housing 10 will be pressed by the piston to flow through the orifice 16 and the pipe 18 (FIG. 2), and flow into the mouth 42, and then flow through the fourth and the fifth rings 37, 38 into the outlet 41 (FIG. 5) such that the hydraulic oil can flow out of the cylinder.

Figure 8:
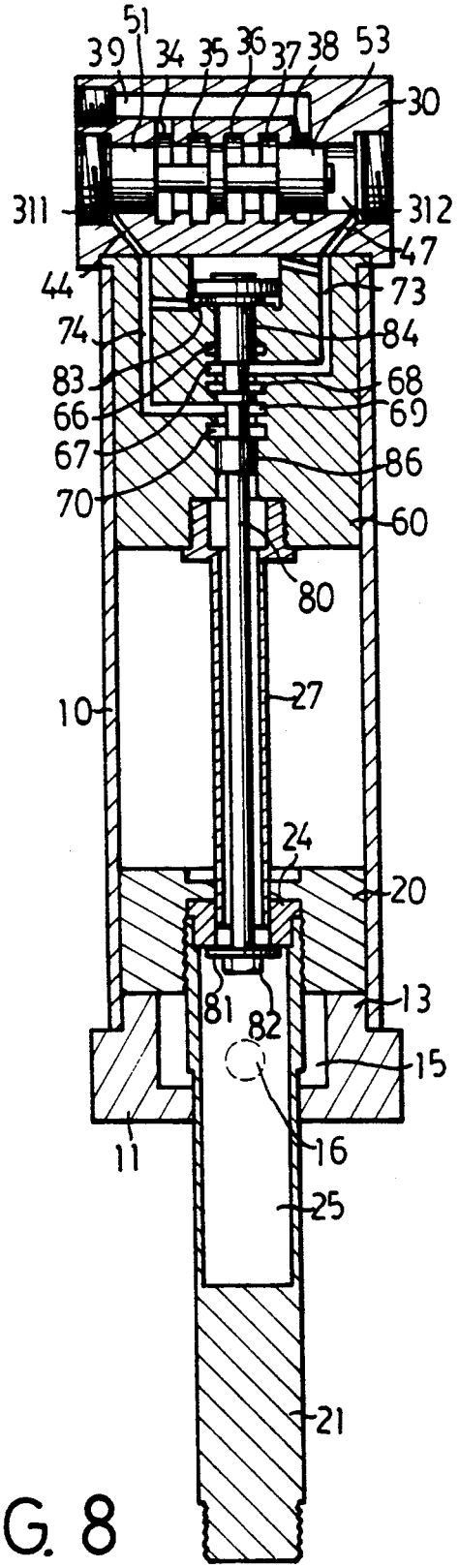
FIG. 8 is cross sectional view similar to FIG. 3.

Referring next to FIGS. 8, 9 and 10, when the piston 20 is pushed downward to the position as shown in FIG. 8, the washer 81 is pulled downward by the piston 20 so that the shaft 80 can be drawn downward to the position as shown in FIGS. 8 and 9. At this moment, the second and the third annular grooves 67, 68 are communicated with each other, the hydraulic oil from the inlet 40, the third hole 45 and the path 76 can flow into the third annular groove 68 (FIG. 9), and flow through the second annular groove 67 and the access 73 (FIG. 8), and then flow into the outer space of the circular plate 83 so that the circular plate 83 can be pushed downward and retained in the downward position, and simultaneously, from the access 73, the hydraulic oil can flow through the fifth hole 47 into the second end 312 of the head 30 so that the disc 53 can be pushed leftward to the position as shown in FIGS. 8 and 10. At this moment, as shown in FIG. 10, the hydraulic oil from the inlet 40 can flow through the third and the fourth rings 36, 37 to the mouth 42 of the head 30, and then flow through the tube 18 (FIGS. 1 and 2) into the cavity 15 and the second chamber of the housing 10 so that the piston 20 can be pushed upward again. When the piston 20 is pushed upward to the position as shown in FIG. 3, the washer 81 and the shaft 80 are pushed upward again. This completes an operation cycle.

When the piston 20 moves upward, the hydraulic oil contained in the first chamber of the housing 10 will be pressed by the piston 20 to flow through the aperture 72 of the body 60 into the first hole 43 of the head 30 (FIG. 10), and to flow through the second and the first rings 35, 34 into the pathway 39 (FIG. 8), and then flow through the fifth ring 38 (FIG. 8) to the outlet 41 (FIG. 10) and flow out of the cylinder.

It is to be noted that the hydraulic oil is supplied into the inlet 40 continuously during the operations of the cylinder, and the piston 20 can be caused to move in a reciprocating action without changing the feeding direction of the hydraulic oil. The cylinder can be operated without microswitches.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cylinder comprising a housing disposed between a head and a board; a body disposed in a first end of said housing and closely contacted with an inner surface of said head; a piston slidably disposed in said housing so that said housing is separated into a first chamber defined between said piston and said body and a second chamber defined between said piston and said board; a piston rod having a first end coupled to said piston and having a second end extended outward through said board, an emptiness being formed in said first end of said piston rod; and a sleeve slidably received in said emptiness of said piston rod and having a first end coupled to said body; a passage being laterally formed in said head, five rings being formed in series in said passage and having a diameter larger than that of said passage, a pathway connecting a first ring to a fifth ring, an inlet being formed in said head and connected to a third ring for supplying hydraulic oil into said third ring, an outlet being formed in said head and connected to said fifth ring, a mouth being formed in said head and connecting a fourth ring to said second chamber of said housing, five holes being formed in said inner surface of said head and including a first hole connected to said a second ring, a second hole connected to a first end of said passage, a third hole connected to said third ring, a fourth hole connected to said fifth ring, and a fifth hole connected to a second end of said passage; a rod slidably received in said passage of said head and having three first discs integrally formed thereon such that two first annular gaps being formed therebetween, an outer diameter of said first discs being equal to an inner diameter of said passage, said first annular gaps having a width large enough for every two adjacent rings to be communicated with each other; a passageway being longitudinally formed in said body, a recess being formed in an end portion of said body for slidably receiving a plate, said recess being separated by said plate into an outer space and an inner space, five annular grooves being formed in said passageway and having a diameter larger than an inner diameter of said passageway, an aperture being formed through said body and communicated between said first hole of said head and said first chamber of said housing, an access communicating a second annular groove to said outer space of said recess and to said fifth hole of said head, an approach communicating a fourth annular groove to said inner space of said recess and to said second hole of said head, a channel communicating a fifth annular groove to a first annular groove and to said fourth hole of said head, and a path communicating a third annular groove to said third hole of said head; a shaft being slidably received in said passageway of said body and in said sleeve, said plate being fixed to a first end of said shaft, a washer being fixed to a second end of said shaft and engageable with said sleeve, three second discs being integrally formed on said first end of said shaft such that two second annular gaps being formed therebetween, an outer diameter of said second discs being equal to an inner diameter of said passageway, said second annular gaps having a width large enough for every two adjacent annular grooves to be communicated with each other; said hydraulic oil supplied into said inlet flowing through said third hole, said path, said third and said fourth annular grooves, said approach and then flowing into said inner space of said recess to push said plate toward said head so that said first and said second annular grooves are communicated with each other and said third and said fourth annular grooves are communicated with each other; said hydraulic oil supplied into said inlet also flowing through said second hole and flowing into said first end of said passage in order to push said first discs toward said second end of said passage so that said second and said third rings are communicated with each other and said fourth and said fifth rings are communicated with each other; said hydraulic oil then flowing through said third and said second rings, said first hole, said aperture, and then flowing into said first chamber of said housing in order to push said piston toward said board; said washer and said shaft being pushed by said piston when said piston moves toward said board so that said plate is caused to move toward said inner space of said recess and said second discs are caused to move toward said piston, and so that said second and said third annular grooves are communicated with each other, said hydraulic oil supplied into said inlet flowing through said third hole, said path, said third and said second annular grooves, said access and then flowing into said outer space of said recess so as to push said plate toward said inner space of said recess, said hydraulic oil from said access also flowing through said fifth hole and into said second end of said head so as to push said first discs toward said first end of said passage, said hydraulic oil from said inlet may flow into said third and said fourth rings, said mouth and flow into said second chamber of said housing so as to push said piston toward said body; such that said piston can be urged to move in a reciprocating action.

2. A cylinder according to claim 1, wherein a protrusion is formed on said board and is engaged in said housing, a cavity is formed in said board and communicated with said second chamber of said housing, an orifice is formed in said board, and a pipe is connected between said cavity and said mouth.

3. A cylinder according to claim 1 further comprising a gasket having a first annular flange formed on one end thereof and engaged between said piston and said piston rod, said gasket being slidably engaged on said sleeve.

4. A cylinder according to claim 1, wherein a circular depression is formed in one surface of said head, said body having a second annular flange formed on one end thereof and engaged in said circular depression of said head and engaged between said head and said housing so that said body can be kept closely contacting said head.

5. A cylinder according to claim 4, wherein a first pin hole is formed in said head and a second pin hole is formed in said body, and a pin is engaged in said first pin hole and said second pin hole such that said body can not rotate relative to said head.

6. A cylinder according to claim 1, wherein an annular slot is formed in said body and communicated with said inner space of said recess, said approach is communicated with said annular slot.

7. A cylinder according to claim 1, wherein an inner thread is formed in each end portion of said passage for threadedly engagement with a screw.

* * * * *